United States Patent [19]

Halliburton et al.

[11] 4,424,970

[45] Jan. 10, 1984

[54] PANIC POST FOR PINBALL GAMES

[75] Inventors: Ronald D. Halliburton, Delray Beach; James H. Pearson, Oakland Park, both of Fla.; Robert J. Sava, San Jose, Calif.

[73] Assignee: Bally Manufacturing Corporation, Chicago, Ill.

[21] Appl. No.: 349,298

[22] Filed: Feb. 16, 1982

[51] Int. Cl.[3] ..... A63F 7/02; A63F 7/26

[52] U.S. Cl. ..... 273/121 A; 273/129 S

[58] Field of Search ..... 273/119–122, 273/88, 89, 129 R, 129 S, 129 V, 129 W

[56] References Cited

U.S. PATENT DOCUMENTS

| | | | |
|---|---|---|---|
| 1,980,125 | 11/1934 | Whitney | 273/89 |
| 2,035,271 | 3/1936 | MacDougall | 273/129 S UX |
| 3,298,691 | 1/1967 | Berninger et al. | 273/129 R |
| 3,578,802 | 5/1971 | Murphy et al. | 273/129 |

FOREIGN PATENT DOCUMENTS

| | | | |
|---|---|---|---|
| 1373806 | 8/1964 | France | 273/121 A |

*Primary Examiner*—Paul E. Shapiro

*Attorney, Agent, or Firm*—Welsh & Katz

[57] ABSTRACT

A play feature for a pinball machine includes one or more movable bumper posts placed near entrances to passages through which a ball will exit from the play of the game. When the bumper post is not actuated the ball can pass freely through a passage entrance. Actuation of the bumper post moves the post parallel to the surface of the playfield to a position hindering ball access to the passage. Bumper post motion may be sufficiently rapid to impart a considerable component of momentum in the direction of motion of the bumper post to the ball when the post contacts the ball.

8 Claims, 3 Drawing Figures

PANIC POST FOR PINBALL GAMES

This invention relates generally to pinball games. More particularly, this invention relates to means by which a player can extend his time of play by preventing a ball from exiting from a playfield.

BACKGROUND OF THE INVENTION

A pinball game challenges a player to keep a ball in rolling motion on an inclined playfield for as long as possible. The playfield contains various contact points which, when struck by a rolling ball, award points to the player. In the simplest versions of pinball the player has some control over the motion of the ball by causing the playfield to move slightly just at the time the ball is making contact with one of the contact points. The player is therefore able to impart momentum to the ball in a direction over which he has some control. On the other hand, the ball when left to its own devices will ultimately roll into an exit path where the ball is directed to the lowest level of the playfield, at which point it will exit from the game. Persons familiar with pinball will appreciate that the game challenges a player to keep the ball out of the playfield's exit paths. Such persons will be aware of the moment of panic that occurs when the ultimate challenge has not been met and another ball is lost.

In more sophisticated versions of pinball additional means may be provided to the player to enable him to keep the ball out of the exit paths. For example, in one well-known version of a pinball game there are flippers placed on the playfield just above an entrance to an exit hole, or out-hole, at the bottom of the playfield. A player can activate the flippers by pushing a button available to him. If the flippers are activated when the ball is within the range of the flippers then substantial momentum may be imparted to the ball, propelling it upward on the playfield to a position comparable to the position the ball had at the beginning of play. A player with skill and coordination can use the flippers to prolong substantially the play of a game and postpone the inevitable moment of panic when the ball finally escapes through an exit passage. Play will not be indefinitely prolonged, however, because the ball may pass directly through a space provided between the flippers which is out of reach of either flipper so that no contact can be made between flippers and ball. Alternatively the ball may pass out of play through a different exit passage which is not guarded by flippers.

Another means for prolonging the play of a pinball game is exemplified by Frank T. Murphy, Norman R. Clark, and William E. Casey U.S. Pat. No. 3,578,802. Murphy, et al. provide raisable bumpers, or contact points as previously described, which are normally flush with the surface of the playfield. The player is provided with buttons which will cause specified bumpers to rise vertically above the surface of the playfield to a position where they can be struck by the ball. The raisable bumpers may be placed at entrances to exit paths so that the skillful activation by a player will prevent a ball from entering the exit path. The raisable bumper, however, lacks a desirable feature of flippers in that the bumper carries no momentum of its own that can be imparted to the ball. That is, a flipper functions dynamically and is capable of returning a ball to an initial position at the top of a playfield regardless of the ball's momentum when impacted by the flipper. The raisable bumper, on the other hand, will only return the ball to a height dependent upon the ball's momentum at the time of striking the bumper.

SUMMARY OF THE INVENTION

The present invention is related to a means combining the advantages of flippers and of raisable bumpers.

Broadly stated, a specific construction embodying the principles of the present invention is a pinball machine comprising an inclined playfield, a ball, means for propelling the ball onto the playfield, one or more pivotally mounted flippers disposed near the playfield for affecting motion of the ball, contact points on the playfield cooperating with means for scoring contacts between the ball and the contact points, an out-hole, and passages through which the ball may pass during the play of the game. Some of the passages are out-of-play lanes in that they lead to terminal sections of the playfield. By "terminal section" is meant a section in which the ball cannot change a player score and must ultimately exit from the game either through the out-hole or otherwise.

The specific construction also contains one or more novel play features referred to as "panic posts." By a panic post is meant a movable post which is located near the entrance to an out-of-play lane, or within the lane, in such a fashion that the ball is free to pass through the lane when the panic post has not been actuated by a player. When the panic post is actuated, it will move substantially parallel to the surface of the playfield and block the ball from entering or exiting through the out-of-play lane. The blockage may be momentary or for a predetermined interval of time. The motion of the panic post may be quite rapid such that when it makes contact with the ball it imparts substantial momentum to the ball. When the panic post is actuated it need not completely block an exit passage. The post may only partially block the passage so as to reduce, but not eliminate completely, the chance that the ball will exit through the passage.

It is therefore an object of this invention to add to the excitement and challenge of a pinball game by supplying a player with an additional means for keeping a ball in play by the exercise of skill and coordination.

It is another object of this invention to provide a player of a pinball game with an additional means for propelling the ball into play.

It is a further object of this invention to provide means in a pinball game for blocking a passage of the ball into an exit passage while at the same time imparting substantial momentum to the ball. These and other objects, features, and advantages of the invention will be apparent from the following description of a specific construction of the preferred embodiment as illustrated in the accompanying drawings:

DETAILED DESCRIPTION OF A SPECIFIC CONSTRUCTION OF A PREFERRED EMBODIMENT

Figure 1:
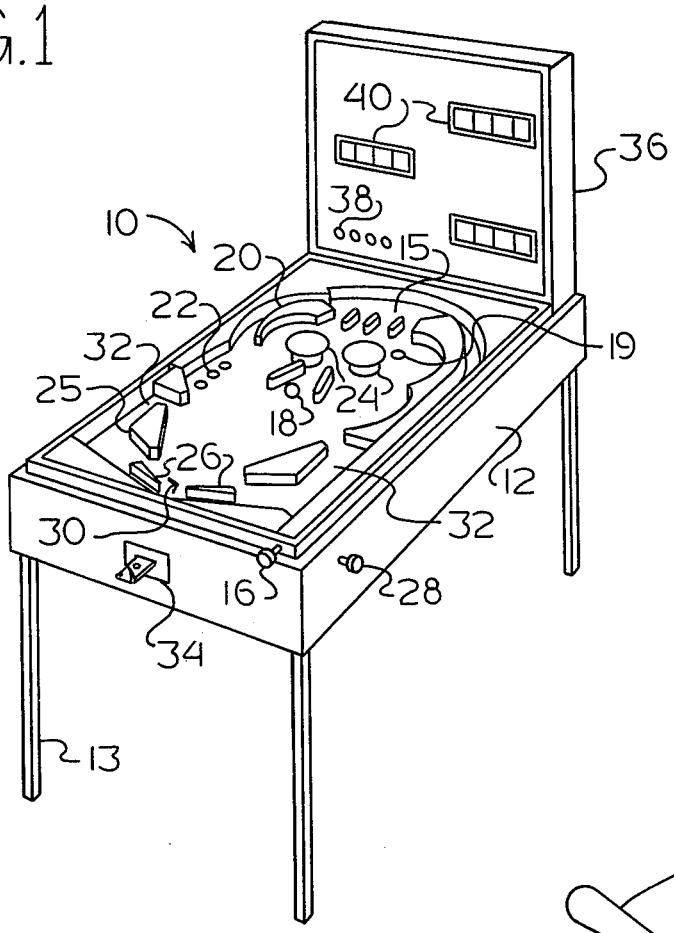
FIG. 1 illustrates a pinball machine suitable for use with the present invention and shows examples of exit passages and also of a pair of flippers.

Referring more specifically to FIG. 1, a pinball machine 10 includes a cabinet 12 supported on legs 13 approximately at waist height to the usual game player. The cabinet 12 has a glass top beneath which is located a slightly inclined bordered playfield 15. A manual ball-feeding mechanism 16 is located at the lower right-hand corner of the playfield and is used for ejecting a ball 18 to the upper end of the playfield 15 at the start of play. The ball then rolls under the influence of gravity downwardly over the slightly inclined playfield against and past a plurality of ball directing and target means located on the playfield.

In the illustrated apparatus, the ball directing and target means shown include kick-out holes 19, upper guide rails 20, spaced drop targets 22, thumper bumpers 24, and a slingshot kicker 25. Additionally, a pair of flippers 26 selectively controlled by manual left and right actuators 28 straddle and define a central out-of-play lane 30. A pair of side out-of-play lanes 32 are also defined on the sides of the playfield. Once the ball passes through one of the out-of-play lanes, it is lost; either a subsequent ball is then available to be put into play, or the game is over.

A coin mechanism 34 is located on the front of the cabinet to accept coins in the proper amount to enable play for the number of players desired. A back cabinet 36 is typically also provided, being glass covered and having suitable decorative and game operation material thereon. Thus, player indicating means 38 advises visually which player is playing, and the players' score area 40 provides continuous updated scores in digital display for the respective players. Other indicators can include a tilt notice, ball in play indicators, and flashing score-related lights not specifically identified.

The game apparatus may vary widely with respect to the particulars of the scoring as the ball moves about the playfield and against the various ball directing means and/or target means. Basically, however, each ball directing or target means, upon being hit by the ball, redirects the ball, adds to the score of the player, or both. A control disclosed in Nutting et al. U.S. Pat. No. 4,093,232 or in Bracha et al. U.S. Pat. No. 4,198,051, both of which are incorporated herein by reference, can be provided for totaling the score and for illuminating the lights, according to some prearranged logic of the game apparatus, as the ball caroms about the playfield.

Figure 2:
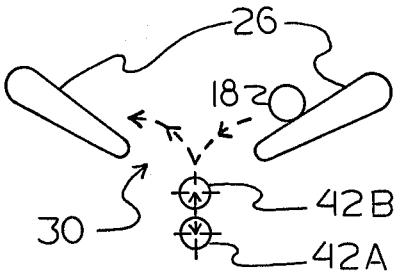
FIG. 2 illustrates the positioning and motion of a panic post placed between a pair of flippers on the playfield of FIG. 1 in accordance with the principles of the present invention.

In accordance with the present invention a panic post 42 is disposed in the out-of-play lane 30 between the flippers 26, as shown in FIG. 2. The panic post is shown in its normal position at 42A. In such position, it does not substantially block the out-of-play lane 30, and the ball 18 is free to go into the out-of-play lane, if the flippers 27 are not actuated to propel the ball away from that lane. When the panic post is actuated, however, it moves into the position 42B as indicated by the dotted circle in FIG. 2. The panic post thereby partially blocks the exit through the out-of-play lane for a predetermined period of time, thereby hindering the ball 18 from rolling through the out-of-play lane. Alternatively, the panic post in position 42B may completely block the out-of-play lane.

When the panic post shown in FIG. 42B is actuated to a position only partially blocking the lane 30, then there is a possibility that the ball 18 will escape through the out-of-play lane. That is, if the ball shown in FIG. 2 rolls very slowly, it can drop through the aperture remaining between one of the flippers 26 and the panic post in position 42B. Conversely, if the ball is moving rapidly it will bounce from one flipper to the other by caroming off the panic post as shown by the direction-of-travel arrows in FIG. 2.

As may be evident from the figure, the panic post moves in a direction substantially parallel to the surface of the playfield when it is actuated. It may be designed to move with substantial speed so that if it contacts the ball 18 during the motion of the panic post it could impart a substantial component of momentum in the direction of the panic post's motion to the ball. The panic post may also be constructed of material with resiliency so that the ball will rebound from the post substantially elastically, thereby sharply changing the direction of the ball's momentum on the playfield.

Although FIG. 2 shows the panic post 42 situated with respect to the central out-of-play lane 30, it would also be within the teachings of the present invention to locate the panic post so that when actuated it could block a side out-of-play lane or such other passages as may be designed on the playfield through which the ball would exit from the active playing area.

Figure 3:
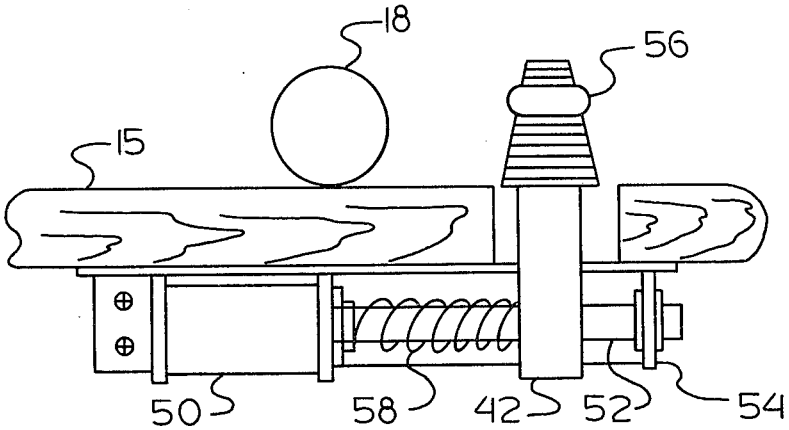
FIG. 3 illustrates a particular construction of the panic post of FIG. 2 and an activating solenoid in a preferred embodiment of the present invention.

A particular construction of the panic post could be in accordance with FIG. 3. A solenoid 50 is mounted underneath the playfield 15 so that the solenoid axis is substantially parallel to the playfield. A cylindrical ferro-magnetic shaft 52 is slideably mounted within the solenoid such that the central magnetic field of the solenoid will align substantially with the axis of the shaft. The shaft projects out of the solenoid and its free end is slideably supported in a support 54. The axes of the shaft and solenoid, which are intended to be approximately coincident, are preferably aligned with the direction along which the panic post moves when the solenoid is activated. In that event the panic post 42 may be rigidly attached to the shaft 52 and project through an opening in the playfield sufficiently large to permit the desired motion of the panic post. A portion of the panic post may thereby project into the playing area of the playfield and that portion may bear a rubber ring 56 which could serve as a bumper when the panic post is struck by a ball.

The mounting of the panic post is such that there will ordinarily be a space along the shaft between the panic post and the solenoid. The panic post may be coupled to the solenoid support by a compression spring 58.

The solenoid ordinarily comprises a current-carrying wire connected to a power source by a player-activated switch. When the switch is activated, current flows in the solenoid, thereby creating an axial magnetic field which in turn creates an attractive force on the shaft 52. The shaft 52 is thereby forced into the solenoid in a direction substantially parallel to the surface of the playfield to the extent permitted by the aperture in the playfield which contains the panic post 42. When the panic post makes contact with the portion of the aperture nearest the solenoid, the travel of the shaft out of the solenoid necessarily ends. When current stops flowing in the solenoid then the compression spring 58, which was compressed by the travel of the shaft, exerts a force upon the panic post that causes the panic post to travel back away from the solenoid, thereby bringing the shaft back into its original position as shown at 42A. Travel of the panic post is terminated by the portion of the aperture in the playfield furthest from the solenoid, as indicated in FIG. 3.

The solenoid-shaft assembly in a particular construction utilized a slight modification of a slingshot assembly normally used to propel a ball onto a playfield. Other types of slingshot assemblies may also be modified to provide for low cost implementation of the panic post feature.

Control of current through the solenoid may be effected by a momentary contact switch which causes only a momentary pulse of current to flow through the solenoid and thereby causes the panic post to move rapidly first in a direction into the solenoid and then back out again. Another alternative is to permit the switch to cause current to flow in the solenoid as long as the switch is activated so that the player determines the length of time that the panic post is in its most extreme position within the solenoid. Other arrangements are possible including the use of a timing circuit which determines the length of time that the current will flow in the solenoid. Persons skilled in the art of pinball design may conceive of other combinations or arrangements for controlling current in the circuit or for disposing the panic posts on the playfield within the teachings of the present invention.

It is understood that any switch or switches controlling one or more panic post solenoids would be mounted on the outside of the apparatus shown in FIG. 1. Such switches could be located near one of the flipper actuators 28. The precise location could be chosen to challenge a player's coordination as he moves his hand rapidly from flipper actuators to panic post actuators and back again.

It will of course be understood that modification of the present invention in its various aspects would be apparent to those skilled in the art, some being apparent only after study and others being a matter of routine design. For example, it is not a necessary feature of the invention that it be applied only to conventional pinball games. It could as well be applied to other games involving a ball rolling on an inclined plane with out-of-play lanes. As such, the scope of the invention should not be limited by the particular embodiment and specific construction herein described, but should be defined only by the appended claims and equivalents thereof.

What is claimed is:

1. Apparatus for playing pinball comprising:

an inclined playfield upon which a ball rolls during play, said playfield having a plurality of contact points cooperable with means for effecting a game score in response to contacts between said ball and said contact points;

means for propelling the ball onto the playfield;

means for scoring;

at least one out-hole;

at least one passage through which the ball may pass during play of the game, the passage having an entrance and leading to a section of the playfield in which the ball cannot change the score before the ball enters the out-hole; and a play feature comprising an upstanding bumper post, means supporting said bumper post for rectilinear movement in a direction substantially parallel to the playfield between a first position enabling movement of the ball through said passage and a second position substantially blocking the entrance to the passage so as to hinder the ball from moving through the passage, and actuator means enabling selective movement of said bumper post between said first and second positions.

2. Apparatus for playing pinball in accordance with claim 1 wherein said play feature is activated by a slingshot assembly.

3. Apparatus for playing pinball in accordance with claim 1 in which said bumper post is constructed of material having resiliency.

4. Apparatus for playing pinball in accordance with claim 1 wherein said movable bumper post is actuatable by means of an externally mounted switch.

5. Apparatus for playing pinball in accordance with claim 1 wherein said actuator means includes a switch controlled solenoid, said switch being operable to permit current to flow in said solenoid for the entire time said switch is in an actuating position.

6. Apparatus for playing pinball in accordance with claim 1 wherein said actuator means includes a switch controlled solenoid, said switch being operable to permit current to flow in said solenoid, and a timing circuit for determining the length of time of current flow after operation of said switch.

7. Apparatus for playing pinball in accordance with claim 1 wherein said actuator means enables selective movement of said bumper post from said first to said second positions so as to impact a ball entering said entrance end of said passage and substantially reverse its direction of movement.

8. Apparatus for playing pinball comprising:

an inclined playfield upon which a ball rolls during play, said playfield having a plurality of contact points cooperating with means for scoring contacts between said ball and said contact points;

means for propelling the ball onto the playfield;

means for scoring;

at least one out-hole;

at least one passage through which the ball may pass during play of the game, the passage leading to a section of playfield in which the ball cannot change the player score before the ball enters the out-hole; and a play feature comprising a bumper post actuatable by a player and when actuated movable substantially parallel to the playfield to a position substantially blocking the entrance to the passage so as to hinder the ball from passing through the passage during a time interval, and when not actuated leaving the passage free for passage of the ball;

said movable bumper post being actuatable by means of an externally mounted momentary contact switch, and said time interval being substantially equal to the time of closure of said momentary contact switch.

* * * * *